US008439054B2

(12) United States Patent
Rhines

(10) Patent No.: US 8,439,054 B2
(45) Date of Patent: May 14, 2013

(54) PAINTING IMPLEMENT CLEANING AND SUPPORT APPARATUS

(76) Inventor: Michael Rhines, Orange, TX (US)

( * ) Notice: Subject to any disclaimer, the term of this patent is extended or adjusted under 35 U.S.C. 154(b) by 564 days.

(21) Appl. No.: 12/799,357

(22) Filed: Apr. 23, 2010

(65) Prior Publication Data

US 2011/0258805 A1 Oct. 27, 2011

(51) Int. Cl.
*A46B 17/06* (2006.01)
*B05C 17/005* (2006.01)
*B08B 3/02* (2006.01)

(52) U.S. Cl.
USPC ..... 134/198; 15/104.92; 15/142; 15/201; 15/230.11; 15/248.1; 15/248.2; 15/257.01; 134/38; 134/182; 134/201

(58) Field of Classification Search ..... 15/104.92, 15/142, 201, 230.11, 248.1–248.2, 257.01; 134/38, 182, 198, 201, 900
See application file for complete search history.

(56) References Cited

U.S. PATENT DOCUMENTS 2,449,818 A * 9/1948 Olsen ..... 134/143
2,659,096 A * 11/1953 Mencfeldowski, Jr. .... 15/257.06
2,724,848 A * 11/1955 Horvath ..... 15/104.92
2,773,274 A * 12/1956 Becch ..... 15/3
2,794,265 A * 6/1957 Kruger ..... 34/58
2,831,488 A * 4/1958 Anderson ..... 134/138
2,884,709 A * 5/1959 Kruger ..... 34/58
2,938,368 A * 5/1960 Bixel ..... 68/205 R
2,965,111 A * 12/1960 Feigelman ..... 134/135
3,075,534 A * 1/1963 Habostad ..... 134/138
3,087,190 A * 4/1963 Werner ..... 401/121
3,133,548 A * 5/1964 Carr ..... 134/138
3,139,891 A * 7/1964 Faustman ..... 134/138
3,421,527 A * 1/1969 Dettman ..... 134/138
3,422,828 A * 1/1969 Dommer ..... 134/138
3,428,060 A * 2/1969 Spivey ..... 134/141
3,472,251 A * 10/1969 Parker, Jr. ..... 134/138
3,577,280 A * 5/1971 George ..... 134/138
3,587,599 A * 6/1971 Bywater ..... 134/138
3,688,785 A * 9/1972 Stevens et al. ..... 134/138
3,755,840 A * 9/1973 Barger ..... 15/1
3,818,529 A * 6/1974 Leggett ..... 15/1
3,837,035 A * 9/1974 Habostad ..... 15/257.06
3,873,364 A * 3/1975 Smith ..... 134/138
3,886,960 A * 6/1975 Krueger ..... 134/138
3,897,797 A * 8/1975 Wright et al. ..... 134/113
4,061,153 A * 12/1977 Doherty ..... 134/138
4,108,189 A * 8/1978 Claiborne et al. ..... 134/138
4,130,124 A * 12/1978 Sherwin ..... 134/138

(Continued)

*Primary Examiner* — Arlen Soderquist
(74) *Attorney, Agent, or Firm* — Kenneth D. Baugh

(57) ABSTRACT

A painting implement cleaning and storage apparatus 10 is provided. The painting implement cleaning and storage apparatus of this invention facilitates the cleaning and storage of painting implements such as a roller 12, a brush 14 and a roller pan 16. The apparatus of this invention is provided with a base support member 18. The roller 12 is supported on the base support member 18 in an upwardly extending diagonal position adjacent a shield 70 for containing paint spreads from the roller in a predetermined confined area. The brush 14 is supported on the base support member in a predetermined upwardly projecting position. A roller pan 16 is coupable to the base support member 18 and supported thereon in a diagonally descending position.
Once the painting implements 12, 14 and 16 are supported on the apparatus 10, cleaning of the desired implement can be accomplished by the application of a stream of water thereto in a predetermined manner after which the implement can be left to dry until they are needed again.

11 Claims, 2 Drawing Sheets

U.S. PATENT DOCUMENTS 4,142,540 A * 3/1979 Vegiard ..... 134/138
4,294,272 A * 10/1981 Klaiber ..... 134/138
4,402,333 A * 9/1983 Frizzell et al. ..... 134/138
4,446,590 A * 5/1984 Kirchner et al. ..... 15/302
4,549,562 A * 10/1985 Ossi ..... 134/138
4,569,099 A * 2/1986 Harding ..... 15/248.2
4,593,428 A * 6/1986 Calvert ..... 15/248.2
4,641,673 A * 2/1987 Conley et al. ..... 134/138
4,667,363 A * 5/1987 Calvert ..... 15/248.2
4,672,987 A * 6/1987 Brandt ..... 134/138
4,711,258 A * 12/1987 Rossborough et al. ..... 134/138
4,733,679 A * 3/1988 Dolcater ..... 134/138
4,809,722 A * 3/1989 Pennise ..... 134/138
4,823,424 A * 4/1989 Allen ..... 15/104.92
4,832,066 A * 5/1989 Shipman ..... 134/137
5,005,598 A * 4/1991 Hodgdon ..... 134/138
5,050,626 A * 9/1991 Brockage et al. ..... 134/138
5,095,928 A * 3/1992 Phipps ..... 134/138
5,238,012 A * 8/1993 Coronato ..... 134/140
5,363,869 A * 11/1994 McDowell ..... 134/104.2
5,402,808 A * 4/1995 Wallis et al. ..... 134/104.2
5,406,967 A * 4/1995 Eberle ..... 15/104.92
5,409,027 A * 4/1995 Glunt ..... 134/138
5,413,133 A * 5/1995 Russell ..... 134/138
5,487,399 A * 1/1996 Hannah ..... 134/138
5,505,220 A * 4/1996 Gorecki ..... 134/138
5,626,158 A * 5/1997 Gratopp ..... 134/138
5,641,007 A * 6/1997 Falk ..... 141/106
5,816,275 A * 10/1998 Mullen ..... 134/141
5,839,459 A * 11/1998 Bisby ..... 134/138
6,019,111 A * 2/2000 Gillies ..... 134/138
6,408,862 B1 * 6/2002 van Rooyen ..... 134/138
6,450,185 B1 * 9/2002 Sallinen ..... 134/138
2005/0224104 A1 * 10/2005 Bleyaert ..... 134/151
2006/0048804 A1 * 3/2006 Walter ..... 134/198
2006/0060221 A1 * 3/2006 Beaver ..... 134/33
2006/0213544 A1 * 9/2006 Schmitt ..... 134/184
2006/0272683 A1 * 12/2006 Wallace ..... 134/138
2007/0089765 A1 * 4/2007 Clark ..... 134/103.2
2007/0221260 A1 * 9/2007 Watters et al. ..... 134/149
2008/0072932 A1 * 3/2008 Nicholas ..... 134/34
2008/0078429 A1 * 4/2008 Hoffmann ..... 134/178
2008/0105284 A1 * 5/2008 Bates ..... 134/198
2009/0217952 A1 * 9/2009 Moar ..... 134/38
2010/0300500 A1 * 12/2010 McPhee, III ..... 134/198

* cited by examiner

PAINTING IMPLEMENT CLEANING AND SUPPORT APPARATUS

TECHNICAL FIELD

This invention relates to painting implements and more particularly to an apparatus to be used in cleaning painting implements such as paint brushes, paint rollers and roller pans. It has long since been recognized that painting by professionals as well as non-professionals has been and will continue to be a very necessary activity. Because of the nature of the activity it is understood that the painting operation is not complete until the somewhat tedious process of cleaning the painting implements, that is the brush, roller and roller pan is done. It is also understood that proper cleaning of the implements extends their useful life and the need to replace them after each painting.

However, several problems arise regarding the cleaning process. First of all the cleaning process can be somewhat unpleasant because one of the more effective methods of cleaning the implements is of course by hand. This can take a significant amount of time, and can be extremely messy and result in washing spreads of paint all over the painter's body and clothing. Additionally once the cleaning process is completed the process of drying the implements and then storing them for future use can be problemsome. Accordingly it is desirable to provide an apparatus that can facilitate the cleaning process so that the messy washing spreads of paint are minimized while also allowing the implements to readily dry and be stored for future use.

BACKGROUND OF THE ART

Attempts have been made to provide painting tool cleaning apparatuses that minimize the messiness of the clean up process. One such apparatus is disclosed in U.S. Pat. No. 4,569,099. The apparatus is a paint roller washing shield. The apparatus includes a shield and a semi-cylindrical handle extending from the shield for receiving the handle of the roller. The shield receives the paint roller with a portion of the roller extending outwardly from the shield so it can be exposed to a stream of water from a water hose to facilitate cleaning while minimizing unwanted messy paint spreads.

Another arrangement is disclosed in U.S. Pat. No. 5,406,967. This invention discloses an apparatus for cleaning a paint brush. In this cleaning apparatus a paint brush is located through an exit region of an elongated cavity of a nozzle-like housing. A cleaning fluid such as water enters the housing from an entry region at the water end of the cavity. This arrangement permits easy and gentle cleaning of paint from the bristles of the brush upon application of water.

These arrangements are suitable for the purposes intended. That is, to provide a cleaning apparatus for a paint roller and paint brush, respectively. However there is a need for an apparatus that will facilitate the cleaning of a paint roller, paint brush and paint roller pan all in a single apparatus. Additionally there is a need for this same apparatus to facilitate the drying of the painting implements and then storage for later use.

DISCLOSURE OF THE INVENTION

A painting implement cleaning and storage apparatus is provided. The painting implement cleaning and storage apparatus of this invention facilitates the cleaning and storage of painting implements such as rollers, brushes and roller pans. The apparatus of this invention is provided with a base support member. A first member is coupled to first portions of the base support member so that a roller can be supported thereon in an upwardly extending diagonal position.

A shield, for containing paint spreads from the roller in a predetermined confined area, is coupled to second portions of the base support member adjacent the roller. The apparatus of this invention is also provided with a second member which is coupled to third portions of the base support member for supporting a paint brush therein in a predetermined position.

The base support member of the apparatus is also provided with a support means which supports a paint roller pan in a diagonally descending position. Once a painting implement is supported on the apparatus of the invention, cleaning of the desired implement can be accomplished by the application of a stream of water thereto in a predetermined manner.

BRIEF DESCRIPTION OF THE INVENTION

The details of the invention will be described in connection with the accompanying drawing in which.

BEST MODE FOR CARRYING OUT THE INVENTION

Figure 1:
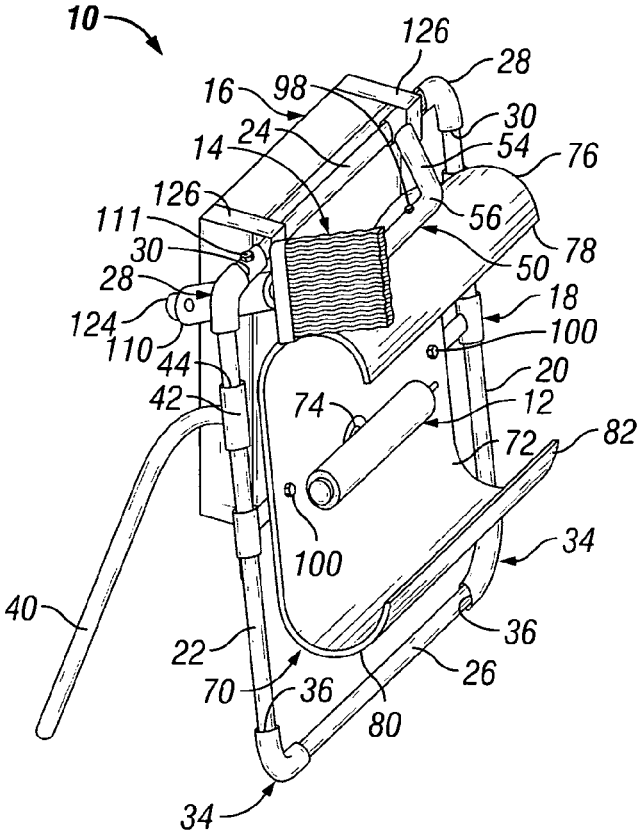
FIG. 1 is a front perspective view illustrating a painting implement cleaning and support apparatus in accordance with the principles of the invention.
Figure 2:
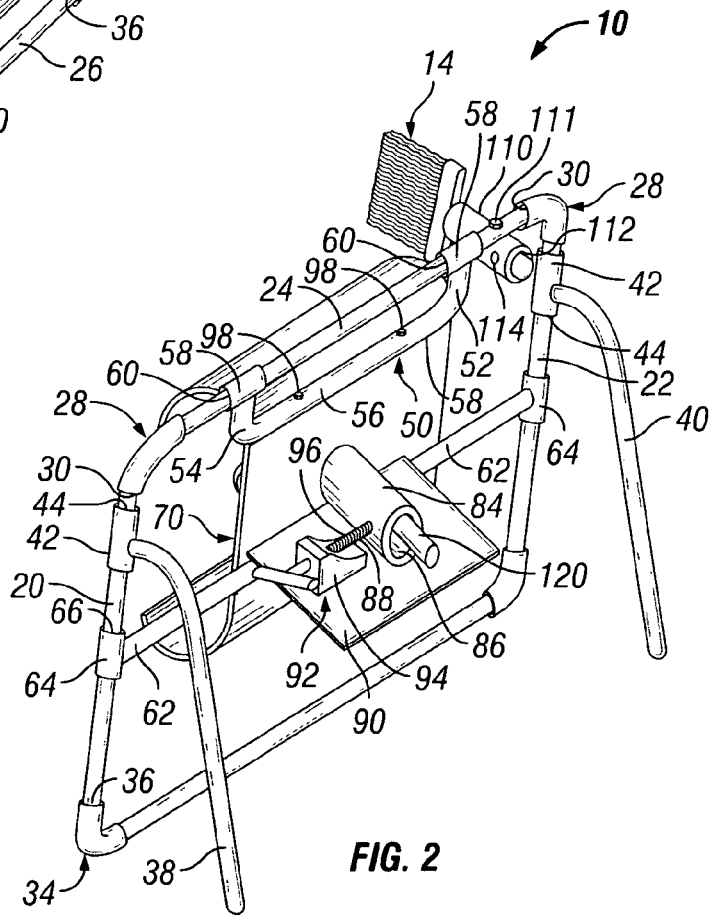
FIG. 2 is back perspective view illustrating a painting implement cleaning and support apparatus in accordance with the principles of the invention.
Figure 3:
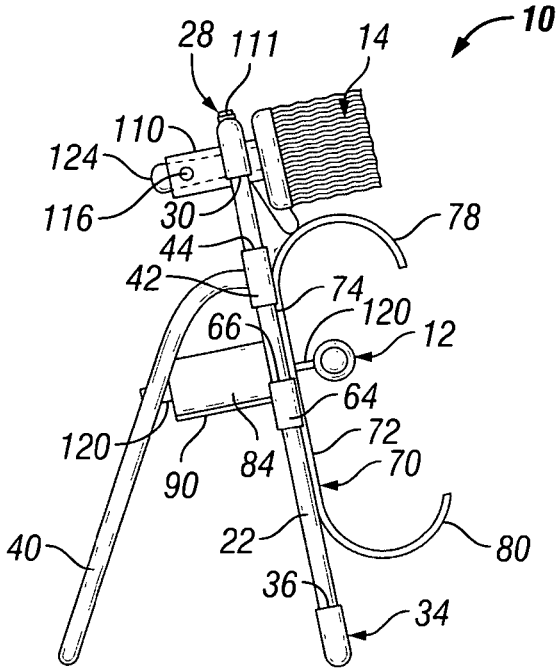
FIG. 3 is a side view of a painting implement cleaning and support apparatus illustrated in FIG. 2 in accordance with the principles of the invention.
Figure 4:
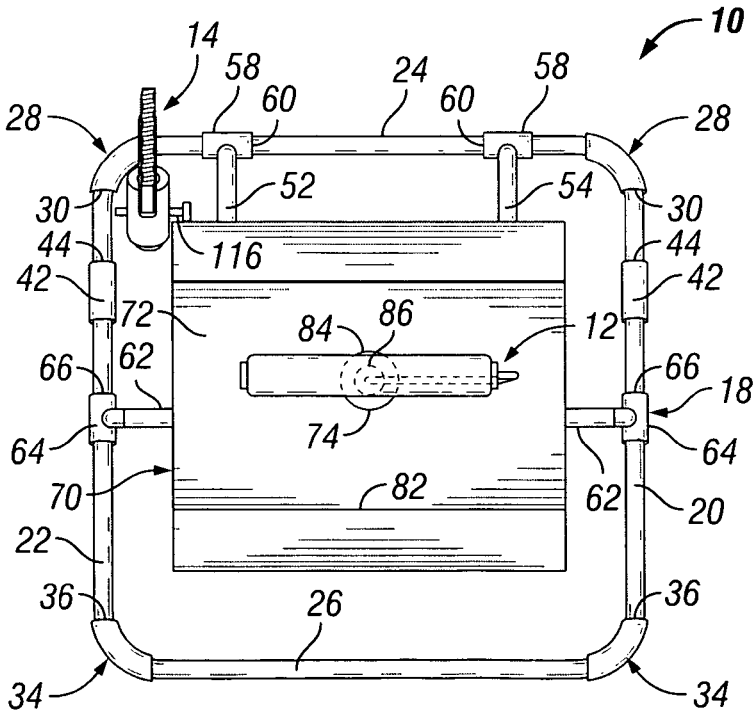
FIG. 4 is a front view of a painting implement cleaning and support apparatus illustrated in FIG. 2 in accordance with the principles of the invention.

Referring to FIGS. 1, 2, 3 and 4 a painting implement cleaning and support apparatus, generally designated by the numeral, 10 is provided. The apparatus 10 is provided for cleaning painting implements such as, for example, a paint roller, generally designated, by the numeral, 12, a paint brush, generally designated by the numeral 14 and a paint roller pan, generally designated, by the numeral 16. (FIG. 1)

The apparatus 10 includes a base support member, generally designated, by the numeral 18. The base support member 18 is provided with a pair of spaced front vertically extending legs 20 and 22, and upper and lower spaced horizontally extending members 24 and 26, respectively. The horizontally extending member 24 is coupled to extend between uppermost portions of the vertically extending legs 20 and 22 of the support member 18 by coupling arms, generally, designated, by the numeral 28, which each includes an opening 30 extending the length thereof. The opening 30 of the coupling arm 28 allows the horizontally extending member 24 to be couplingly engaged on each end thereof with one end of the adjacently aligned coupling arm. Likewise, the opening 30 of the coupling arm 28 also allows the vertically extending legs 20 and 22 to be couplingly engaged with the adjacently aligned coupling arm in another end of the opening.

The lower horizontally extending member 26 is coupled to extend between lowermost portions of the vertically extending legs 20 and 22 by coupling arms, generally, designated by the numeral 34 which are provided with an opening 36. The lower horizontally extending arm 26 is coupled between the lowermost portions of the vertically extending arms 20 and 22 in the same manner as coupling is achieved with regard to the upper horizontally extending arm 26.

The base support member 10 is also provided with a pair of diagonally descending legs 38 and 40. The legs 38 and 40 include coupling arms 42 having an opening 44 extending therethrough. The coupling arms 42 allows the legs 38 and 40 to be coupled to the vertically extending legs 20 and 22 respectively.

The painting apparatus 10 is also provided with a u-shaped upper support bracket, generally designated, by the numeral, 50. The bracket 50 includes a pair of spaced downwardly descending arms 52 and 54 and a horizontally extending arm 56 coupled therebetween. The arms 52 and 54 each include coupling arms 58 having an opening 60 extending therethrough. The arms 52 and 54 are coupled by the coupling arm 58 to the horizontally extending member 24 in the same manner previously described.

The apparatus 10 is also provided with an intermediate horizontally extending member 62. The intermediate horizontally extending member 62 includes coupling arms 64 with an opening 66 extending therethrough. The intermediate horizontally extending member 62 is coupled between the vertically extending legs 20 and 22 at intermediate portions thereof by the coupling arms 64 in the same manner as previously described with regard to the other coupling arms.

The apparatus 10 is further provided with a shield, generally designated, by the numeral, 70. The shield 70 is provided with a vertically extending planar shaped member 72 which includes an opening 74 formed in an intermediate portion thereof.

The shield 70 is also provided with a semi-circular shaped upper member 76 coupled to uppermost portions of the planar shaped member 72 so that portions 78 thereof extend downwardly in a substantially vertically projecting direction, and a semicircular shaped lower member 80 coupled to lowermost portions of the planar shaped member so that portions 82 thereof extend upwardly in a substantially vertically projecting direction.

The shield 70 is also provided with an elongated support member 84 which is supported on the back of the planar shaped member 72. The elongated support member 84 has an internal opening 86 formed therein which is aligned adjacent to the opening 74 in the planar shaped member 72. The elongated support member 84 is additionally provided with an opening 88 which is formed on an outer surface thereof to extend into the internal opening 86. A rectangularly shaped support member 90 is provided to support the elongated member 84 in a diagonally descending direction on the planar shaped member 72. The elongated support member 84 also includes an engaging member, generally designated, by the numeral 92. The engaging member 92 includes a support block 94 and an engaging screw 96 threadely supported therein for forward and backward movement in the block. The engaging member 92 is coupled on the support member 90 so that the engaging screw is aligned in the opening 88 to be moved into and out of the opening 86 when desired.

The shield 70 is coupled to the u-shaped upper support bracket 50 by coupling the upper member 76 thereof to the horizontally extending arm 56 of the bracket with a threaded coupling members 98 and to the intermediate horizontally extending member 62 by threaded coupling members 100.

The apparatus 10 is also provided with a second elongated support member, generally designated, by the numeral, 110 which is coupled by coupling member 111 to the horizontally extending support member 24 of the base support member 18. The second elongated support member includes an internal elongated opening 112 (FIG. 2) formed therethrough. The second elongated support member 110 is also provided with an opening 114 which is formed on an outermost surface thereof to extend into the internal opening 112. An engaging member 116 (FIG. 4) is mounted for movement in the opening 114.

When it is desired to clean the roller 12, the roller is supported in the apparatus by inserting a handle 120 of the roller in the opening 86 in the elongated support member 84. The engaging screw 96 is then moved into the opening 86 to engage the handle 120 so that the handle is held in a stationary position. This positions the roller 12 in the shield in an upwardly ascending diagonal position so that the upper and lower members 78 and 82 respectively are above and under the roller. In this position once a spray of water from, for example, a water hose, is directed against the exposed portion of the roller the roller will spin thereby allowing the paint to be washed out of the roller. While this is going on because of the position of the roller 12 adjacent the shield the user is shielded from the paint and water spray that would normally spread over the user and other areas in proximity of the user.

Similarly when it is desired to clean the brush 14 a handle 124 of the brush is supported in the apparatus 10 by inserting the handle 124 in the opening 112 of the second elongated support member 110 so that the brush is supported upright in the opening. The engaging member 116 (FIGS. 3, 4) is then inserted through the opening 112 of the elongated support member 110 and into an opening 128 in the handle 124. This holds the brush 14 in place in the elongated support member 110. In this instance a spray of water can be directed first at one side of the brush 14 and then at the other side until the brush is thoroughly clean.

Additionally, when it is desired to clean the roller pan 16 the pan is supported on the horizontally extending support member 24 of the base support member 18 by a pair of legs 126 forming a part of the pan. This allows the pan 16 to be supported in a diagonally descending position so that once a spray of water is applied thereto a thorough cleaning of the pan can be achieved.

Once the cleaning process is completed the paint roller 12, paint brush 14 and roller pan 16 can be left in the designated position thereby allowing them to dry and be stored for future use.

It should also be understood that the painting implement cleaning and support apparatus 10 may be provided with a drip pan (not shown) in which the apparatus may sit to catch and contain the washing spreads of paint therein for later disposal.

It should be further understood that various changes and modifications can be made without departing from the spirit of the invention as defined in the claim.

What is claimed:

1. A painting implement cleaning and supporting apparatus including:

a base support member;

a first means aligned with and coupled to first portions of the base support member for supporting a roller thereon;

a shield aligned with and coupled to second portions of the base support member for containing a paint spread from the roller in a predetermined confined area;

a second means aligned with and coupled to third portions of the base support member for supporting a brush thereon in a predetermined diagonal position;

a means included in the base support member for supporting a roller pan thereon in a predetermined diagonally descending position; and means for selectively supplying water to the roller, brush and roller pan to facilitate the cleaning thereof.

2. A painting implement cleaning and supporting apparatus as defined in claim 1 wherein the base support member includes:

a pair of spaced vertically extending legs; and a pair of horizontally extending members spaced from each other with one of the pair aligned between and coupled to uppermost portions of the pair of vertically extending leg and with the other one of the pair aligned between and coupled to lower portions of the pair of vertically extending legs.

3. A painting implement cleaning and supporting apparatus as defined in claim 2 wherein the base support member further includes a pair of diagonally descending legs, one of the pair of diagonally descending legs being coupled to intermediate portions of the vertically extending legs and the other one of the pair of diagonally descending legs being coupled to intermediate portions of the other one of the vertically extending legs.

4. A painting implement cleaning and supporting apparatus as defined in claim 3 which further includes a support member coupled to the base support member the support member including;

a first downwardly extending arm coupled to an upper one of the horizontally extending members;

a second downwardly extending arm spaced from the first downwardly extending arm and coupled to the upper one of the horizontally extending member; and a horizontally extending arm coupled between the first and second downwardly extending arms.

5. A painting implement cleaning and supporting apparatus as defined in claim 4 further including an intermediate horizontally extending support member coupled between the pair of vertically extending legs at intermediate portions thereof.

6. A painting implement cleaning and supporting apparatus as defined in claim 5 wherein the shield further includes:

a vertically extending planar shaped member, having an opening formed in an intermediate portion thereof;

a semi-circularly shaped upper member coupled to the horizontally extending arm of the first support member;

an intermediate planar portion coupled to the intermediate horizontally extending support member; and a semi-circularly shaped lower member aligned with the semi-circularly shaped upper member so that a predetermined confined area is formed.

7. A painting implement cleaning and supporting apparatus as defined in claim 6 wherein the shield further includes an elongated support member having an internal opening extending the length thereof which is aligned adjacent to the opening in the planar shaped member, and an outer opening formed on an outer surface thereof which extends into the internal opening.

8. A painting implement cleaning and supporting apparatus as defined in claim 7 wherein the elongated support member further includes a rectangularly shaped support member coupled in a diagonally descending direction on the back of the planar shaped member.

9. A painting implement cleaning and supporting apparatus as defined in claim 8 wherein the elongated support member further includes:

a support block having an aperture formed therein; and an engaging screw threadly supported in the support block for movement therein so that the engaging screw is aligned in the outer opening to be selectively moved into the internal opening in the elongated support member to couplingly engage portions of the roller and hold the roller in a predetermined position when desired.

10. A painting implement cleaning and supporting apparatus as defined in claim 9 wherein the second means includes an elongated support member having an internal opening formed therein and an outer opening formed on an outermost surface thereof to extend into the internal opening and an engaging member coupled for movement in the outer opening into the internal opening to engage portions of the brush so that the brush is held in a predetermined position.

11. A painting implement cleaning and supporting apparatus as defined in claim 10 wherein the elongated support member of the second means is coupled to the upper one of the pair of horizontally extending members.

* * * * *